US009522751B2

(12) United States Patent
Baltes et al.

(10) Patent No.: US 9,522,751 B2
(45) Date of Patent: Dec. 20, 2016

(54) FILLING MACHINE AND METHOD FOR OPERATING A FILLING MACHINE

(75) Inventors: Klaus Baltes, Bergheim (DE); Thomas Ruelker, Dresden (DE)

(73) Assignee: ELOPAK SYSTEMS AG, Glattbrugg (CH)

( * ) Notice: Subject to any disclaimer, the term of this patent is extended or adjusted under 35 U.S.C. 154(b) by 807 days.

(21) Appl. No.: 13/884,066

(22) PCT Filed: Oct. 12, 2011

(86) PCT No.: PCT/EP2011/067765

§ 371 (c)(1),
(2), (4) Date: Jun. 28, 2013

(87) PCT Pub. No.: WO2012/062518

PCT Pub. Date: May 18, 2012

(65) Prior Publication Data

US 2013/0269298 A1 Oct. 17, 2013

(30) Foreign Application Priority Data

Nov. 8, 2010 (DE) ..... 10 2010 050 483

(51) Int. Cl.
*B65B 5/08* (2006.01)
*B65B 3/02* (2006.01)
(Continued)

(52) U.S. Cl.
CPC ..... *B65B 5/08* (2013.01); *B65B 3/025* (2013.01); *B65B 43/285* (2013.01); *B65B 65/006* (2013.01)

(58) Field of Classification Search
CPC ..... B65B 3/025; B65B 3/02; B65B 65/006; B65B 5/08; B65B 43/285; B65B 43/126; B65B 43/165; B65B 43/265; B65B 43/305; B65B 43/48; B65B 43/50; B65B 43/54; B65B 43/60
(Continued)

(56) References Cited

U.S. PATENT DOCUMENTS 3,373,663 A 3/1968 Heim
3,848,394 A * 11/1974 Heisler ..... B65B 5/08 198/348
(Continued)

FOREIGN PATENT DOCUMENTS

DE 102004003188 8/2005
DE 102008041109 2/2010
(Continued)

*Primary Examiner* — Thanh Truong
*Assistant Examiner* — Thomas Wittenschlaeger
(74) *Attorney, Agent, or Firm* — Lucas & Mercanti, LLP

(57) ABSTRACT

A filling machine includes a plurality of parallel-running conveyor lines, to which packaging jackets are supplied for producing the packaging containers and along which the packaging jackets or the packaging containers produced therefrom are conveyed in a conveying direction. The conveyor lines include a first section and a second section therebehind in the conveying direction the distance between at least two of the conveyor lines in the first and second section transverse to the course of the conveyor lines is different so that at least one of the two conveyor lines in the second section runs with a lateral offset to the first section. A handling apparatus is disposed in the conveying direction upstream of the second section, which apparatus takes the packaging jackets or packaging containers from the conveyor lines in the first section and transfers them to the conveyor lines in the second section.

9 Claims, 5 Drawing Sheets

(51) Int. Cl.
*B65B 43/28* (2006.01)
*B65B 65/00* (2006.01)

(58) Field of Classification Search
USPC ..... 53/458, 558, 563, 564, 565, 574, 575, 53/202; 493/309, 310, 311
See application file for complete search history.

(56) References Cited

U.S. PATENT DOCUMENTS

| | | | | |
|---|---|---|---|---|
| 4,516,381 | A | 5/1985 | Nakajima | |
| 6,112,880 | A | 9/2000 | Flix | |
| 6,357,202 | B1 * | 3/2002 | Bauer | B65B 43/126 53/202 |
| 7,077,259 | B2 | 7/2006 | Breidenbach | |
| 2005/0161306 | A1 * | 7/2005 | Lees | B65B 61/186 198/474.1 |
| 2007/0018468 | A1 | 1/2007 | Behringer | |
| 2010/0199599 | A1 * | 8/2010 | Bonnain | B65B 5/026 53/147 |

FOREIGN PATENT DOCUMENTS

| | | | | |
|---|---|---|---|---|
| FR | WO 2009097546 | A1 * | 8/2009 | B65B 17/025 |
| WO | 8000950 | | 5/1980 | |

* cited by examiner

FILLING MACHINE AND METHOD FOR OPERATING A FILLING MACHINE

CROSS REFERENCE TO RELATED APPLICATIONS

The present application is filed under 35 U.S.C. §371 as a National Stage of International application PCT/EP2011/067765, filed Oct. 12, 2011, which claims priority of DE 10 2010 050 483.1, filed Nov. 8, 2010, the priority of these applications is hereby claimed and these applications are incorporated herein by reference.

BACKGROUND OF THE INVENTION

Field of the Invention

The invention relates to a filling machine for filling in particular flowable products into packaging containers, where the filling machine comprises a plurality of parallel-running conveyor lines to which packaging jackets are supplied for producing the packaging containers and along which the packaging jackets or the packaging containers produced therefrom are conveyed in a conveying direction as well as a method for conveying packaging jackets or packaging containers produced therefrom through such a filling machine.

Description of Prior Art

Filling machines for filling flowable products, in particular, liquid foodstuffs, into packaging containers consisting of cardboard composite material are known from the prior art. For the structure of known filling machines, reference is made, for example, to EP 0 936 992 B1 and DE 41 42 167 C2. The known filling machines usually have a plurality of, for example, four to six parallel-running conveyor lines, also designated as filling lanes, to increase the productivity.

The usually rectangular packaging containers are only produced from packaging blanks provided with folding grooves and stuck together to form packaging jackets in the filling machine on account of the better transportability.

The flat-folded packaging jackets which are combined to form packets, are fed from one of the number of magazines corresponding to the quantity of conveyor lines to the conveyor lines to produce the packaging containers. In the magazines the packaging jackets are arranged as a stack, usually upright, one behind the other. The respectively front packaging jacket is removed from the magazine by means of a removal and unfolding apparatus known per se, which unfolds the packaging jacket to form a tube having a rectangular cross-section.

In the unfolded form, each packaging jacket is transferred by a transport device. The transport devices convey the packaging jackets as well as the packaging containers produced therefrom along the parallel conveyor lines each running in a vertical plane. Along the conveyor lines, the packaging jackets and the packaging containers produced therefrom are sterilised, filled and sealed. The packaging base and therefore the packaging container are usually manufactured immediately before filling.

In particular, transport wheels or circulating conveyor belts having pocket-like receptacles for the packaging containers are used as transport devices. The stepwise-rotating transport wheels have a plurality of parallel receptacles extending radially outwards, whose spacing in the axial direction of the transport wheel corresponds to the spacing of the conveyor lines. The arms are usually configured as mandrels which engage in the unfolded packaging jackets or in the packaging containers; we then talk of a mandrel wheel. In another embodiment of the transport wheel, each receptacle comprises a plurality of arms or profiles which come to rest against the outer side, in particular against the edges of the unfolded packaging jacket or the packaging container. In this case, the receptacles form neighbouring cells into which the unfolded packaging jackets or packaging containers can be inserted; we then also talk of a cell wheel.

If packaging containers having a square cross-section are formed from the flat-folded packaging jackets, the flat-folded packaging jackets are twice as wide as their side edges. If packaging containers having a rectangular cross-section are formed from the flat-folded packaging jackets, the size of the flat-folded packaging jackets is obtained from the sum of the wide plus the narrow lateral edge of the packaging jacket.

As a result of the dimensions of the flat-folded packaging jackets, the adjacently disposed magazines accommodating the upright packaging jackets require a relatively large width dimension of the magazine unit from which the conveyor lines adjoining the respective magazine extend rectilinearly as far as the removal from the filling machine. Due to the design, known multi-track filling machines therefore have a large floor area and as a result, a large construction volume.

The large construction volume of known filling machines is responsible for high machine and operating costs. The accessibility for maintenance and cleaning work, particularly to the central conveyor lines is partially restricted from the longitudinal sides of the filling machine. Furthermore, the cleaning and sterilisation of large sterile areas incurs high costs which result on the one hand from the gas volume for the required sterile gas during the filling process and on the other hand from the cleaning expenses between the filling processes.

SUMMARY OF THE INVENTION

Starting from this prior art, it is the object of the invention to provide a filling machine having improved operating processes, whose manufacturing and operating costs are reduced. Furthermore, an improved method for operating a filling machine is to be proposed.

This object is solved in a filling machine of the type mentioned initially whereby the conveyor lines comprise a first section and a second section therebehind in the conveying direction, in which the conveyor lines run parallel to one another, where the distance between at least two of the conveyor lines in the first and second section transverse to the course of the conveyor lines is different so that at least one of the two conveyor lines in the second section runs with a lateral offset to the first section and that a handling apparatus is disposed in the conveying direction upstream of the second section, which apparatus takes the packaging jackets or packaging containers from the conveyor lines in the first section and transfers them to the conveyor lines in the second section.

As a result of the sectional variation, in particular reduction, of the distance between at least two of the conveyor lines, their accessibility from the longitudinal sides can be improved.

If the total width of the parallel-running conveyor lines is reduced by the sectional change in distance between the conveyor lines, appreciable advantages are obtained in particular in the sterile area of the filling machine due to a reduction in the required working media such as, for example, sterile air or cleaning media.

As a result of the smaller overall width, machine-technical components of the individual stations of the filling machines can be made smaller. This not only results in reduced costs for the manufacture and operation of the filling machine but in additional advantages also for their operating safety.

In order to obtain a different distance between the first and second section of the at least two conveyor lines, at least one of the two conveyor lines runs with lateral offset to the first section. However, both tracks in the second section can run with lateral offset to the first section in order to change the distance between the conveyor lines.

In order to compensate for the offset required for the change in distance in the conveyor line or lines, the handling apparatus is disposed upstream of the second section. The handling apparatus takes over the intermediate transport of the packaging jackets or packaging containers between the first and second section of the conveyor lines running parallel there in vertical planes.

In order to keep the construction volume of the filling machine as small as possible, in a preferred embodiment of the invention the distance between the at least two conveyor lines in the first section is greater than the distance in the second section.

According to the invention, a plurality of first and second sections can be disposed consecutively along the conveyor lines where in each case the first section lies upstream of the second section in the conveying direction and in each cases a handling apparatus for intermediate transport between the sections is provided upstream of the second section.

An advantageous working method is obtained if flat-folded packaging jackets fed to the conveyor lines are unfolded in the first section of the conveyor lines to form rectangular tubes and the unfolded packaging jackets are then taken directly from the conveyor lines in the first section and transferred to the conveyor lines in the second section by means of the handling apparatus, where the distance between all the conveyor lines in the first section is greater than that in the second section.

From the transport means the unfolded packaging jackets or the packaging containers produced therefrom at the beginning of the second section are conveyed at a reduced distance between all the conveyor lines through the sterile area, where the packaging containers are filled under sterile conditions and then sealed.

At the exit from the sterile area it can be appropriate to enlarge the distance between the conveyor lines again for outward transfer of the products from the filling machine. Another handling apparatus is then located at the end of the second section of the conveyor lines and exit of the sterile area.

A compact handling apparatus tuned to the clocked operation of the transport devices of filling machines is characterised in that the handling apparatus each comprises a holder assigned to each conveyor line for the packaging jackets or packaging containers, through which the packaging jackets or packaging containers can be moved in the conveying direction and where the holders assigned to the conveyor lines running with lateral offset are guided transversely to the course of the conveyor lines displaceably between a first and a second position, wherein each displaceable holder is located in the first position in extension of the course of the conveyor line in the first section and in the second position, in extension of the course of the conveyor line in the second section.

The holders assigned to each conveyor line do not interrupt the transport path for the unfolded packaging jackets or the packaging containers produced therefrom and at the same time guide the packaging jackets or packaging containers whilst these taken from the conveyor lines in the first section, are moved through the holders and transferred to the conveyor lines in the second section. The holders guided displaceably transversely to the course of the conveyor lines do not require any significant lengthening of the conveyor lines which extend from the magazines for the packaging jackets as far as the removal of the filled packaging containers.

In order to ensure short clock times during transport of the packaging jackets or packaging containers through the conveying machine, the holders of the handling apparatus are preferably moved synchronously with the aid of a linkage from the first into the second position and conversely. For actuation of the linkage, its ends are for example connected in an articulated manner to the arms of a two-armed pivoting lever.

A handling apparatus having holders preferably guided displaceably transversely to the course of the conveyor lines can preferably be integrated in the conveyor lines if a first transport wheel is disposed in the first section of the conveyor lines and a second transport wheel for conveying the packaging jackets or packaging containers is disposed in the second section of the conveyor lines, where the transport wheel disposed upstream of the handling apparatus in the conveying direction comprises a plurality of parallel receptacles extending radially outwards, whose spacing in the axial direction of the transport wheel corresponds to the spacing of the conveyor lines in the first section and the second transport wheel downstream of the handling apparatus in the conveying direction comprises a plurality of parallel receptacles extending radially outwards, whose spacing in the axial direction of the transport wheel corresponds to the spacing of the conveyor lines in the second section. The advantage of the transport wheels consists in that their receptacles can be aligned onto the holders of the handling apparatus and at the same time take on a guide function when first push elements active in the first position of the holders strip the packaging jackets or packaging containers from the first receptacles aligned onto the holders and insert them into the holders or second push elements active in the second position of the holders push the packaging jackets or packaging containers from the holders in the direction of the second receptacles of the second transport wheel aligned onto the holders.

The first and second push elements used alternately in the conveying cycle of the filling machine can be synchronised in a simple manner by a common drive.

BRIEF DESCRIPTION OF THE DRAWING

The invention is explained in detail hereinafter with reference to the figures. In the figures.

DETAILED DESCRIPTION OF THE INVENTION

Figure 1A:
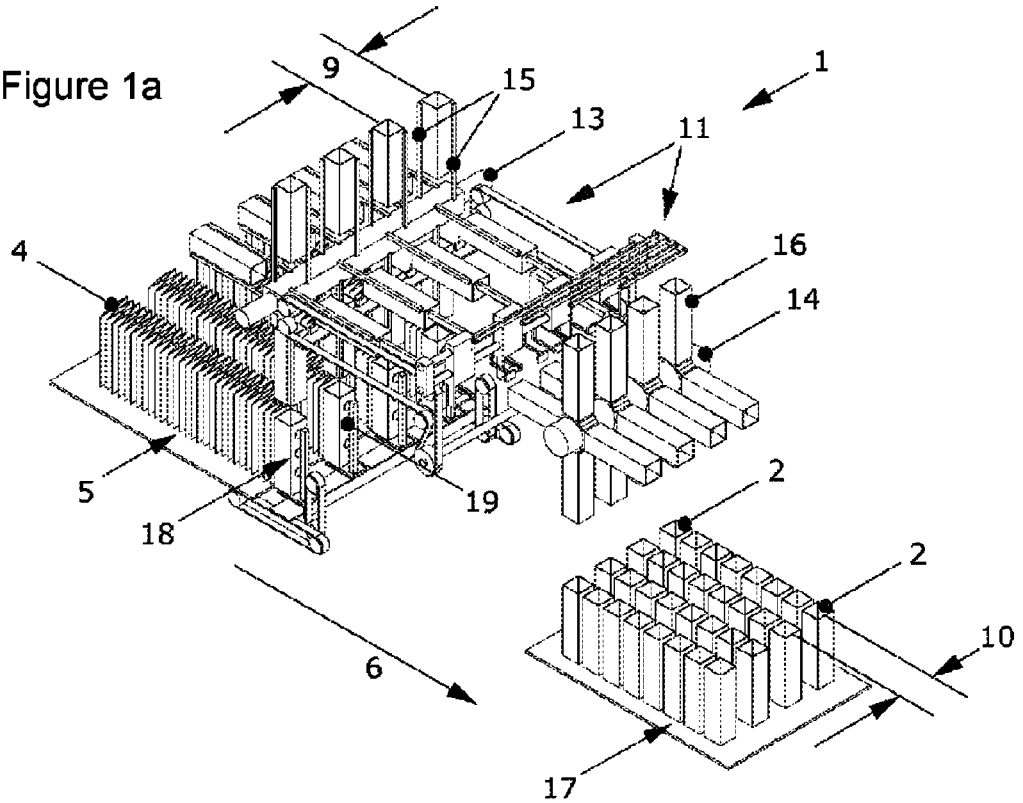
FIG. 1*a* shows a schematic perspective partial view of a filling machine according to the invention.
Figure 1B:
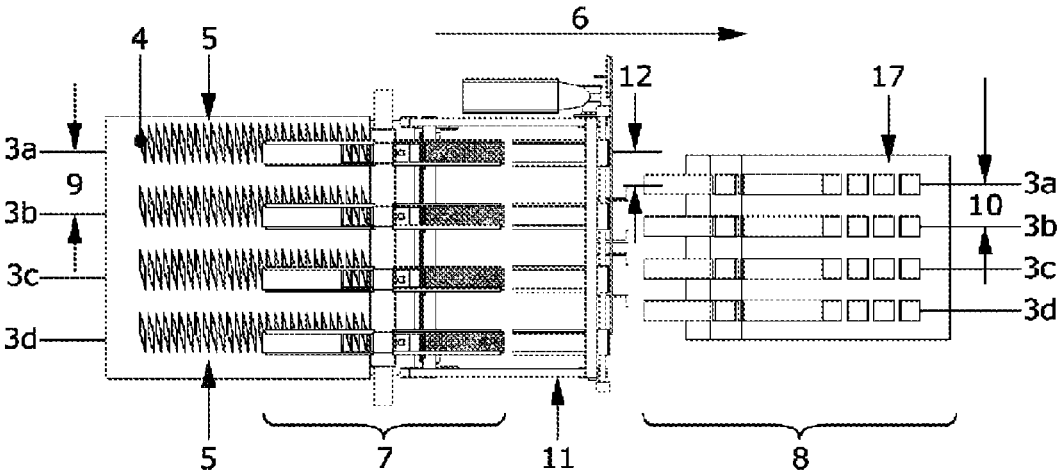
FIG. 1*b* shows a plan view of the filling machine from FIG. 1*a*, FIGS. 2*a*-5*a* show a partial perspective view of the filling machine from FIG. 1*a* to illustrate the operating mode

FIGS. 1*a*, 1*b* show in part a filling machine (1) for filling liquid foodstuffs into packaging containers (2), where the filling machine (1) has four parallel-running conveyor lines (3*a-d*) to which flat-folded packaging jackets (4) are fed to produce the packaging containers (2) from four magazines (5). The packaging jackets (4) and the packaging containers (2) then produced therefrom are conveyed in a common conveying direction (6) along the conveyor lines (3*a-d*) by means of different transport means from the magazines (5) to a removal system for the filled packaging containers (2) at the exit from the filling machine, which is not shown for the sake of clarity.

Located at the front end of each magazine (5) in the conveying direction (6) is a removal and unfolding apparatus (18) for the flat-folded packaging jackets (4) by which means the packaging jackets (4) are removed from the magazine (5) and fed to the conveyor lines (3*a-d*).

All the conveyor lines (3*a-d*) have a first equal-length section (7) and a second section (8) downstream in the conveying direction (6). The distance (9) between the conveyor lines (3*a-d*) in the first section (7) transverse to the course of the conveyor lines (3*a-d*) is greater than the distance (10) transverse to the course of the conveyor lines (3*a*-3*d*) in the second section (8). As can be seen from the plan view in FIG. 1*b*, in the exemplary embodiment shown all the conveyor lines (3*a-d*) run with lateral offset (12) to the first section (7). A handling apparatus (11) is disposed between the first and second section (7, 8) of the conveyor lines (3*a-d*).

The filling machine (1) has a first transport wheel (13) in the first section (7) for conveying the unfolded packaging jackets (4) and a second transport wheel (14) in the conveying direction (6) downstream of the handling apparatus (11). The axes of rotation of both transport wheels (13, 14) run transversely to the conveyor lines (3*a-d*). The first transport wheel (13) is configured as a so-called cell wheel that has a plurality of radially outwardly extending first receptacles (15), each formed by two profiled rods which can be brought to abut against diagonally opposite longitudinal edges of an unfolded packaging jacket (4). The rods are designed, for example, as angle profiles as can be seen from FIG. 2*a*. Four rows with parallel receptacles (15) are arranged offset by 90 degrees over the circumference of the first transport wheel (13). The second transport wheel (14) differs from the first transport wheel (13) in that the second receptacles (16) are configured as mandrels over which the unfolded packaging jackets (4) are pulled. Both transport wheels (13, 14) are turned by a drive, not shown, stepwise by respectively 90 degrees about the axes of rotation of the transport wheels (13, 14) running horizontally and transversely to the conveyor lines (3*a-d*).

The spacing of the first receptacles (15) of the first transport wheel (13) corresponds to the spacing (9) of the conveyor lines (3*a-d*) in the first section (7) whereas the shorter spacing of the second receptacles (16) of the second transport wheel (14) corresponds to the spacing (10) of the conveyor lines (3*a-d*) in the second section (8).

A device for producing the package base is provided on the circumference of the second transport wheel (14) configured as a mandrel wheel. After producing the package base, the second transport wheel (14) transfers the packaging container (2) to a revolving conveyor belt (17) not shown in detail, which conveys the packaging containers through a sterile area not shown as far as the removal system at the exit of the filling machine. In order to ensure an exact positioning of the packaging container (2) on the conveyor belt (17), this usually has upwardly expanding pocket-like receptacles for the packaging containers (2), so that these are further conveyed with the same distance (10) both transversely and longitudinally to the conveying direction (6) in a stepwise manner through the filling machine (1).

The filling machine according to the invention operates as follows:

The flat-folded packaging jackets (4) are fed in a known manner to the adjacently disposed magazines (5) in a vertical position. Retaining elements of the magazines (5), not shown for the sake of clarity, hold the flat-folded packaging jackets in the ordered stack shown in FIGS. 1-5. For removal of the flat-folded packaging jackets (4) from the magazine (5), suckers (19) of the removal and unfolding apparatus (18) act centrally on one of the two front faces of the packaging jacket (4) and pull the packaging jacket individually from the stack. The retaining elements additionally hold the front face of the packaging jacket (4) not gripped by the suckers during the movement of the removal and unfolding apparatus (18) in the conveying direction (6), whereby the packaging jacket (4) is unfolded until it reaches its square cross-section shown in the exemplary embodiment. The unfolded packaging jackets (4) are now pushed from below into the first receptacles (15) of the first transport wheel (13) which turns in the clockwise direction. If all the first receptacles (15) are now successively loaded with respectively one unfolded packaging jacket (4), each packaging jacket (4) held on the right horizontal first receptacle (15) in the diagram is located in the area of the handling apparatus (11) whose structure is explained in detail with reference to FIGS. 2*a*, 2*b:*

The handling apparatus (11) consists of a belt pair (21) driven by means of a drive wheel (20) on both outer longitudinal sides of the handling apparatus (11), on which two cross beams (22, 23) transverse to the conveying direction (6) and the conveyor lines (3*a-d*) are disposed in a bridging manner. Four push elements (25) corresponding to the number of conveyor lines (3*a-d*) are mounted on the first cross beam (22), which is located on the lower strand (24) of the belt pair (21), which push elements strip the unfolded packaging jackets (4) from the first receptacles (15) of the transport wheel (13) through movement of the belt pair (21) in the direction of the arrow (26) by means of stripping hooks disposed on the push elements (25) and insert these packaging jackets into holders (27) located downstream in the conveying direction (6) for receiving the packaging jackets (4).

Figure 3A:
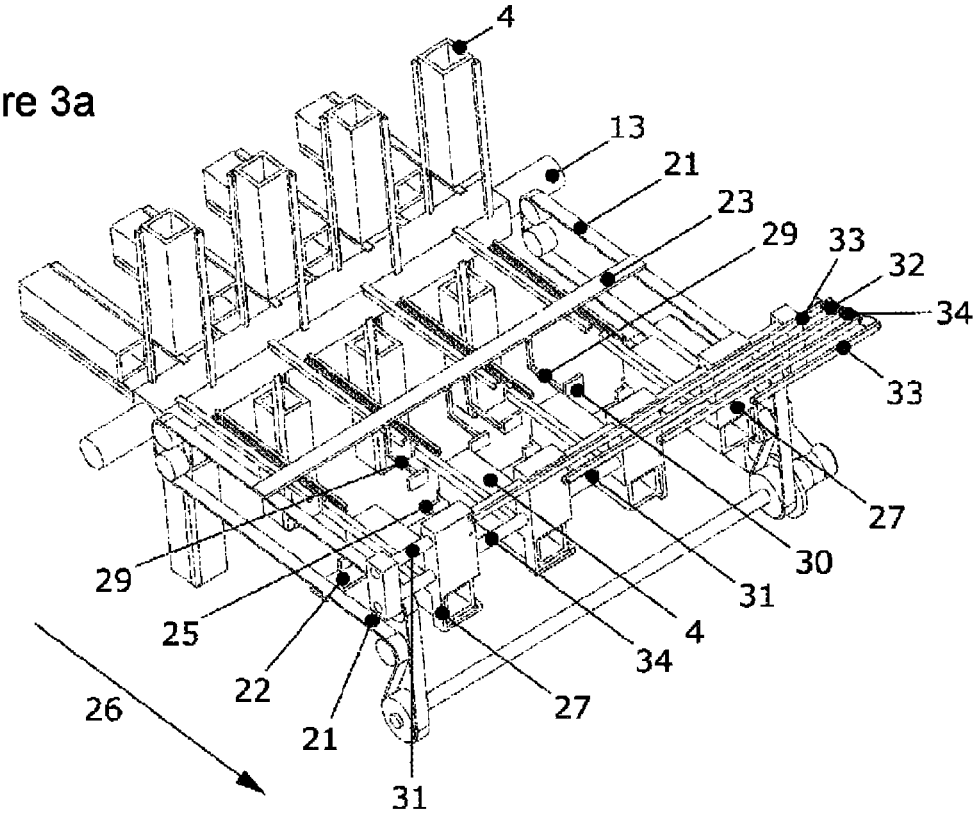

It can be seen from FIG. 3*a* that whilst the cross beam (22) is moved with the push elements (25) in the direction of the arrow (26), the cross beam (23) which is fastened to the upper strand (28) of the belt pair (21) is displaced simultaneously so far to the left in the direction opposite to the direction of the arrow (26) that the push elements (29) arranged on this cross beam (23) according to the number of conveyor lines (3*a-d*) reach with their slider noses (30) behind the faces of the packaging jackets (4) inserted previously into the holders (27).

Figure 2A:
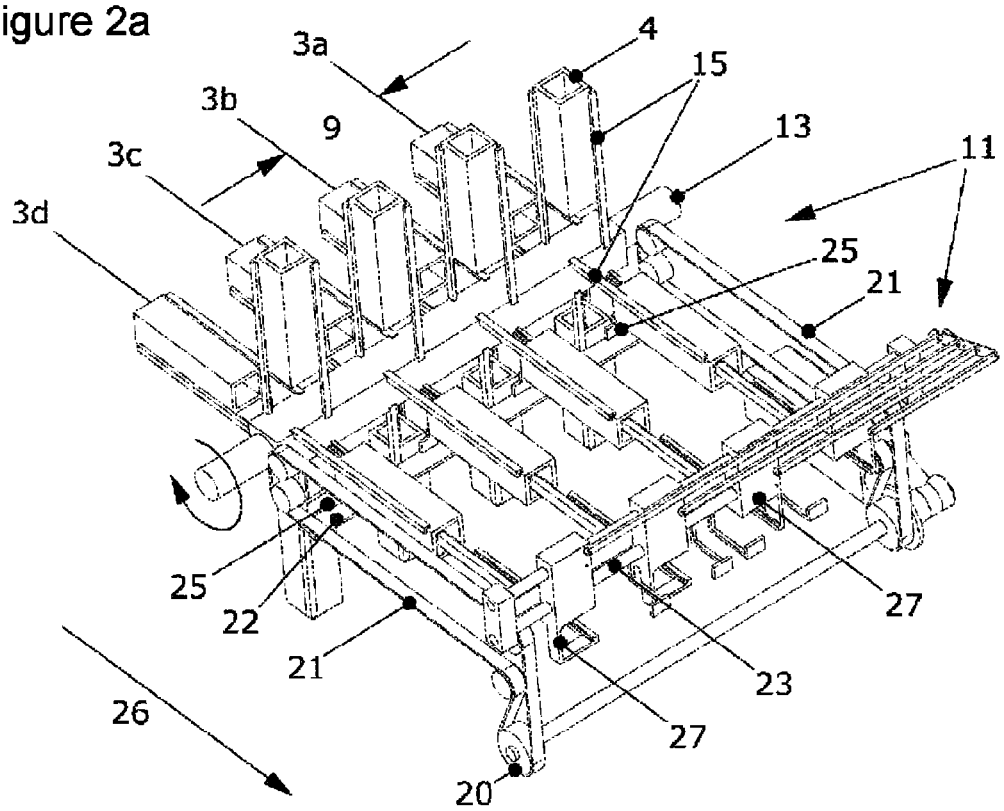
FIGS. 2*b*-5*b* show side views of the filling machine from FIG. 1*a* to illustrate the operating mode.
Figure 2B:
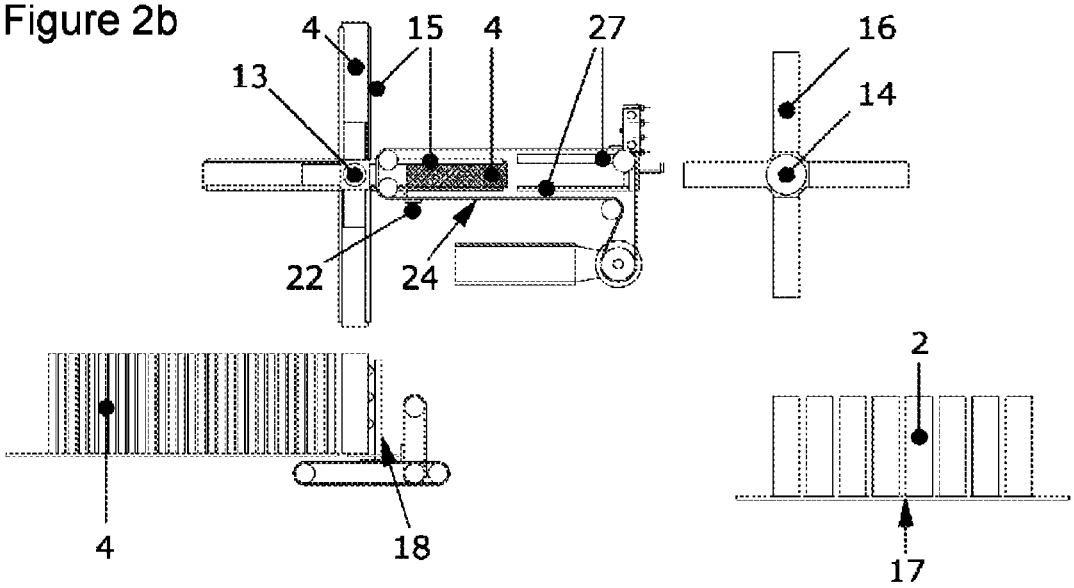
Figure 3B:
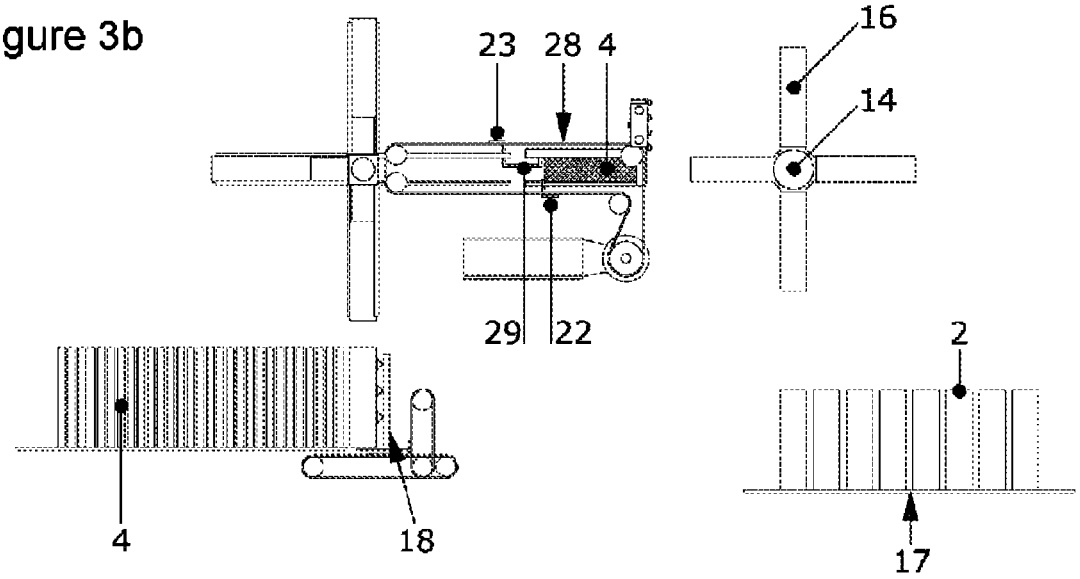

The holders (27) are located in FIGS. 2, 3 in a first position in extension of the course of the conveyor lines (3*a-d*) in the first section (7). In this position of the holders (27) the first push elements (25) are effective as can be identified in particular from FIG. 3*a*.

After the packaging jackets (4) have been inserted completely into the holders (27), the packaging jackets (4) are moved towards one another whereby the holders (27) are brought into a second position in extension of the course of the conveyor lines (3*a-d*) in the second section (8). For this purpose the holders (27) are displaced on their guides (31) towards the centre of the filling machine (1). For this purpose a double pivot lever (32) is pivoted clockwise about a pivot point (34) by means of a drive not shown whereby these are moved towards one another by means of rods (33) between the arms of the double pivot lever (32) and the individual holders (27). Two rods (33) are hinged to each arm of the double pivot lever, where the rods (33) hinged to the outer ends of the arms produce a greater lateral offset (12) of the two outer holders (27) assigned to the conveyor lines (3*a* or 3*d*) than rods (33) hinged further inwards on the double pivot lever (32) which move the two central holders (27) assigned to the conveyor lines (3*b* and 3*c*) towards one another.

Figure 4A:
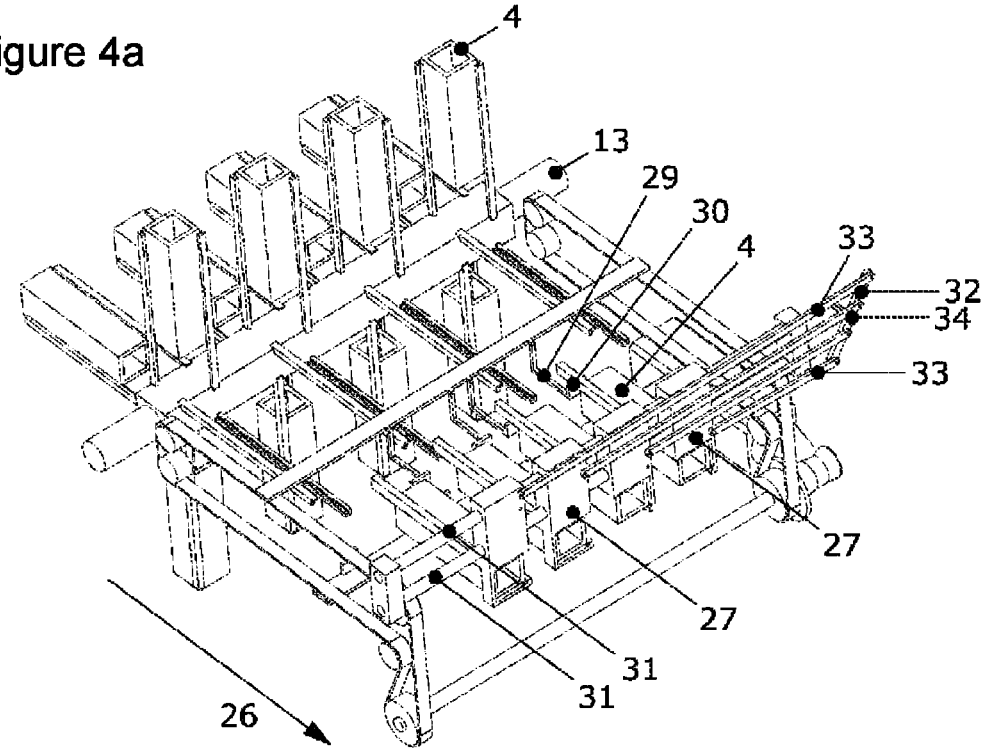
Figure 4B:
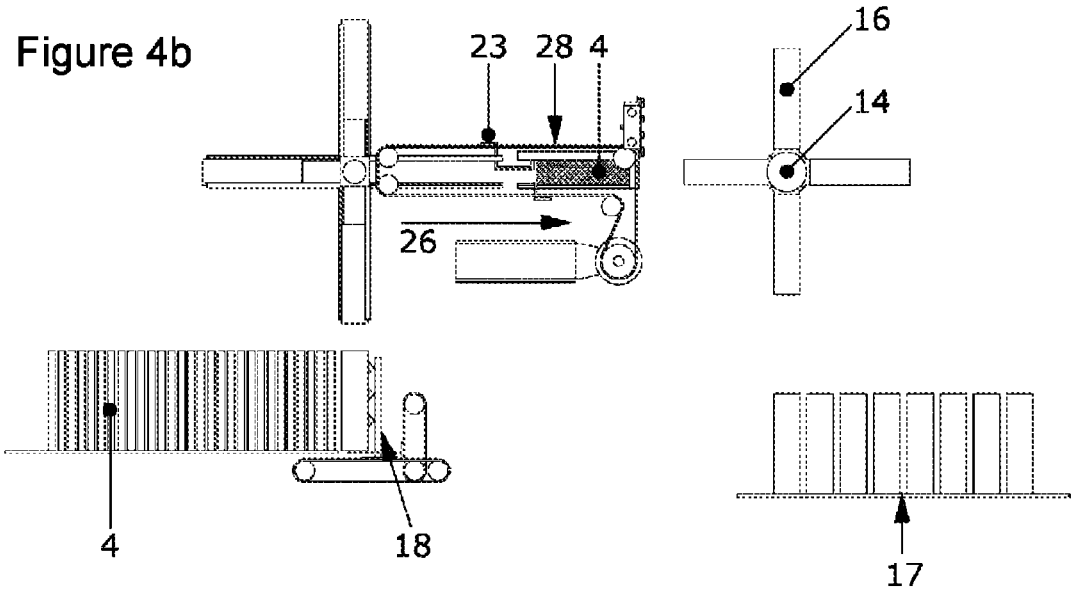
Figure 5A:
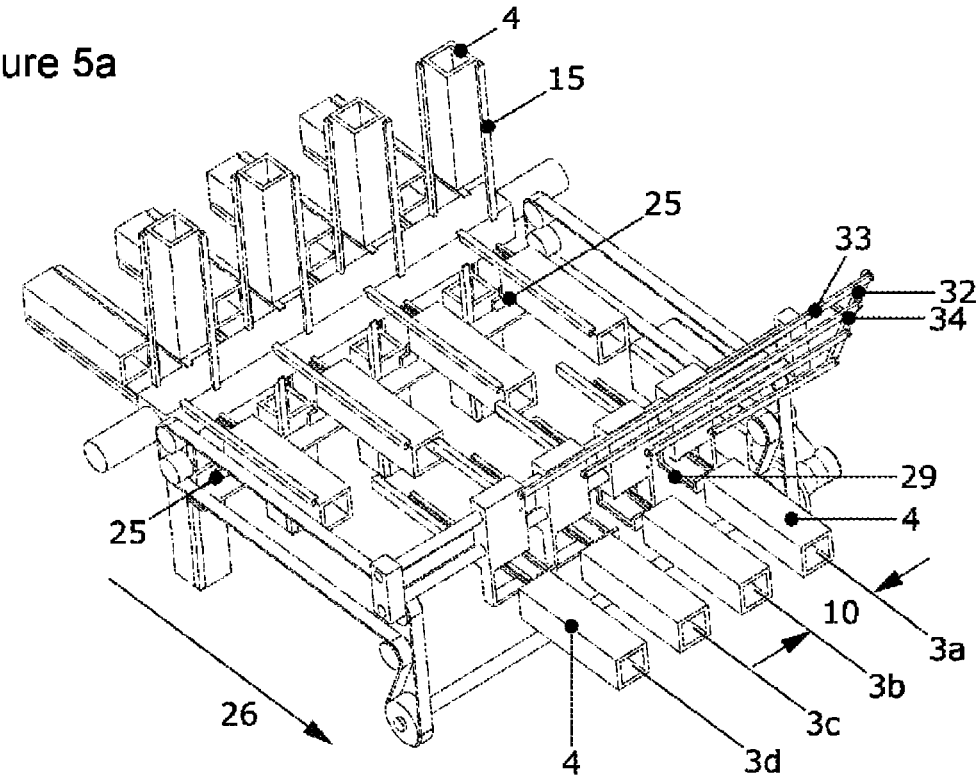
Figure 5B:
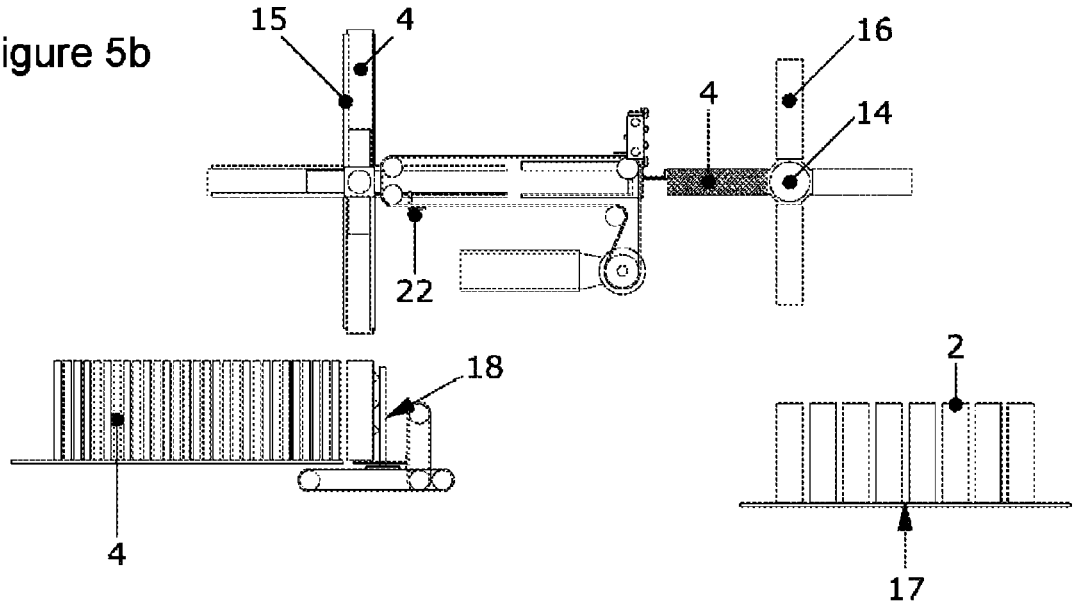

Since the holders are brought in this way into the second position shown in FIGS. 4 and 5 in extension of the course of the conveyor lines in the second section (8), the rear faces of the packaging jackets (4) in the conveying direction enter into the range of action of the slider noses (30) of the push elements (29), as can be seen in particular from FIG. 4*a*.

By reversing the direction of movement of the belt pair (21) in the direction contrary to the direction symbolised by the arrow (26), the packaging jackets (4) are pushed with the aid of the push elements (29) with their slider noses (30) out from the holders (27) in the direction of the conveyor lines (3*a-d*) in the second section (8), as can be seen in particular from FIG. 5*a*. Here the mandrels of the second transport wheel (14) lying in the left horizontal position shown in FIG. 1*a* receive the packaging jackets (4). During this pushing of the packaging jackets (4) out from the holders (27) and the simultaneous transfer to the downstream transport wheel (14), the first push elements (25) on the lower strand (24) migrate again into the initial position shown in FIGS. 2*a* and 5*a* in order to strip the next packaging jackets (4) from the first receptacles (15) of the first transport wheel (13) which in the meantime has been switched further by 90 degrees in the clockwise direction. Adapted to this movement the double pivot lever (32) pivots anticlockwise back into the first position in which the holders (27) are located in extension of the course of the conveyor lines (3*a-d*) in the first section (7) (FIGS. 2, 3).

The cycle of stripping and inserting the packaging jackets (4) into the holders (27) located in the first position then begins anew.

REFERENCE LIST

| No. | Description |
|---|---|
| 1 | Filling machine |
| 2 | Packaging container |
| 3a-d | Conveyor lines |
| 4 | Packaging jacket |
| 5 | Magazine |
| 6 | Conveying direction |
| 7 | First section |
| 8 | Second section |
| 9 | Distance (1) |
| 10 | Distance (2) |
| 11 | Handling apparatus |
| 12 | Lateral offset |
| 13 | Transport wheel (first) |
| 14 | Transport wheel (second) |
| 15 | First receptacle |
| 16 | Second receptacle |
| 17 | Linear conveyor |
| 18 | Removal and unfolding unit |
| 19 | Sucker |
| 20 | Drive wheel |
| 21 | Belt pair |
| 22 | Cross beam |

-continued

REFERENCE LIST

| No. | Description |
|---|---|
| 23 | Cross beam |
| 24 | Lower strand |
| 25 | First push element |
| 26 | Arrow |
| 27 | Holder |
| 28 | Upper strand |
| 29 | Second push element |
| 30 | Slider nose |
| 31 | Guides |
| 32 | Double pivot lever |
| 33 | Rods |
| 34 | Pivot point |
| 35 | |
| 36 | |
| 37 | |
| 38 | |
| 39 | |
| 40 | |
| 41 | |
| 42 | |
| 43 | |
| 44 | |
| 45 | |
| 46 | |
| 47 | |
| 48 | |
| 49 | |
| 50 | |
| 51 | |
| 52 | |
| 53 | |
| 54 | |
| 55 | |
| 56 | |

The invention claimed is:

1. A filling machine for filling products into packaging containers, wherein the filling machine comprises:

a plurality of conveyor lines running in a conveying direction, to which packaging jackets are supplied for producing the packaging containers and along which the packaging jackets or the packaging containers produced therefrom are conveyed in the conveying direction, wherein each of the conveyor lines comprise a first section and a second section therebehind in the conveying direction, the conveyor lines running parallel to one another in the conveying direction, wherein a distance between at least two of the conveyor lines in the first and second section transverse to the conveying direction is different so that at least one of the at least two conveyor lines in the second section runs with a lateral offset to the first section; and a handling apparatus disposed in the conveying direction upstream of the second section, which apparatus takes the packaging jackets or packaging containers from the conveyor lines in the first section and transfers them to the conveyor lines in the second section, wherein the handling apparatus comprises holders assigned respectively to each conveyor line for the packaging jacket or packaging container, through which the packaging jackets or packaging containers can be moved in the conveying direction, and wherein the holders assigned to the conveyor lines running with lateral offset are guided transversely to the course of the conveyor lines displaceably between a first position and a second position, wherein each displaceable holder located in the first position is aligned with a course of the conveyor line in the first section and each displaceable holder located in the second position is aligned with a course of the conveyor line in the second section, wherein the handling apparatus comprises first push elements active in the first position of the holders to push one of the packaging lockets or packaging containers from the first section that are aligned with the holders and insert them into the holders, and wherein the handling apparatus comprises second push elements active in the second position of the holders to push the ones of the packaging jackets or packaging containers from the holders toward the second section of the conveyor lines.

2. The filling machine according to claim 1, wherein the distance between the at least two conveyor lines in the first section is greater than the distance in the second section.

3. The filling machine according to claim 1, wherein the distance between each adjacent pair of the conveyor lines in the first section is greater than that in the second section.

4. The filling machine according to claim 1, further comprising a first transport wheel for conveying the packaging jackets or packaging containers disposed in the first section of the conveyor lines, the first transport wheel comprising a plurality of parallel first receptacles extending radially outwards, whose spacing in the axial direction corresponds to the spacing of the conveyor lines in the first section and a second transport wheel for conveying the packaging jackets or packaging containers disposed in the second section of the conveyor lines, the second transport wheel comprising a plurality of parallel second receptacles extending radially outwards, whose spacing in the axial direction corresponds to the spacing of the conveyor lines in the second section, wherein the push elements strip the ones of the packaging jackets or packaging container's from the first receptacles of the first transport wheel that are aligned with the holders and insert them into the holders and the second push elements strip the ones of the packaging jackets or packaging containers from the holders in the direction of the second receptacles of the second transport wheel aligned with the holders.

5. The filling machine according to claim 4, wherein the first and second push elements have a common drive.

6. The filling machine according to claim 1, further comprising a linkage connected to the holders, wherein the holders can be moved synchronously between the first and second position with the aid of the linkage.

7. A method comprising:

feeding packaging jackets for producing packaging containers into a plurality of conveyor lines of a filling machine running in a conveying direction for filling products into the packaging containers, wherein each of the plurality of conveyor lines run in a conveying direction, conveying the packaging jackets or the packaging containers produced therefrom along a first section and a second section of the conveyor lines located downstream in the conveying direction, in which the conveyor lines run parallel to one another, taking the packaging jackets or packaging containers from the conveyor lines in the first section and transferring them to the conveyor lines in the second section by means of a handling apparatus, wherein a distance between at least two of the conveyor lines in the first section transversely to the conveying direction is different than a distance between the at least two conveyor lines in the second section, so that at least one of the at least two conveyor lines in the second section runs with a lateral offset to the first section, wherein the packaging jackets or packaging containers are moved in the conveying direction through holders respectively assigned to each of the conveyor lines and the holders assigned to the conveyor lines running with lateral offset are transversely, with respect to the conveying direction, movable between a first position and a second position, wherein the holders are brought into the first position aligned with a course of the conveyor lines in the first section and the packaging jackets or packaging containers are taken from the conveyor lines with the aid of first push elements and inserted into the holders and then the holders are brought into the second position aligned with a course of the conveyor lines in the second section and the packaging jackets or packaging containers are pushed out from the holders in the direction of the conveyor lines in the second section with the aid of second push elements.

8. The method according to claim 7, wherein flat-folded packaging jackets supplied to the conveyor lines are unfolded in the first section of the conveyor lines to form rectangular tubes and the unfolded packaging jackets are then taken from the conveyor lines and transferred to the conveyor lines in the second section by means of the handling apparatus, wherein the distance between each adjacent pair of the conveyor lines in the first section is greater than that in the second section.

9. The method according to claim 7, wherein the holders are moved synchronously from the first position into the second position and conversely with the aid of a linkage.

* * * * *